US008974203B2

(12) United States Patent
Crosby et al.

(10) Patent No.: US 8,974,203 B2
(45) Date of Patent: Mar. 10, 2015

(54) HYDRAULIC PUMP END COVER

(75) Inventors: Michael Tholan Crosby, Jonesborough, TN (US); Billie Frances Burleigh, Birmingham, AL (US); Brian Timothy Painter, Chuckey, TN (US)

(73) Assignee: Parker-Hannifin Corporation, Cleveland, OH (US)

( * ) Notice: Subject to any disclaimer, the term of this patent is extended or adjusted under 35 U.S.C. 154(b) by 1306 days.

(21) Appl. No.: 11/930,826

(22) Filed: Oct. 31, 2007

(65) Prior Publication Data

US 2008/0295682 A1 Dec. 4, 2008

Related U.S. Application Data

(60) Provisional application No. 60/921,566, filed on Apr. 3, 2007.

(51) Int. Cl.
*F04B 53/10* (2006.01)
*F04B 1/20* (2006.01)

(52) U.S. Cl.
CPC ..... *F04B 1/2064* (2013.01); *F04B 1/2021* (2013.01)
USPC ..... 417/569; 137/513.7

(58) Field of Classification Search
USPC ..... 417/569, 570, 571, 199.1, 205; 137/513.7; 138/44
See application file for complete search history.

(56) References Cited

U.S. PATENT DOCUMENTS

| | | | | | |
|---|---|---|---|---|---|
| 1,833,340 | A | * | 11/1931 | Smith et al. | 196/110 |
| 2,187,010 | A | * | 1/1940 | Beckman et al. | 48/180.1 |
| 3,361,077 | A | | 1/1968 | Freeman | |
| 3,566,980 | A | * | 3/1971 | Scroggins | 175/65 |
| 3,810,715 | A | | 5/1974 | Week et al. | |
| 3,908,519 | A | | 9/1975 | Born et al. | |
| 4,738,185 | A | | 4/1988 | Kamimura | |
| 5,820,373 | A | * | 10/1998 | Okano et al. | 433/80 |
| 6,332,393 | B1 | * | 12/2001 | Trimble | 92/12.2 |
| 6,354,812 | B1 | | 3/2002 | Todd | |
| 6,386,841 | B1 | | 5/2002 | Probst | |
| 6,494,686 | B1 | | 12/2002 | Ward | |
| 6,651,695 | B2 | * | 11/2003 | Bartos et al. | 137/505.46 |
| 6,672,843 | B1 | | 1/2004 | Holder et al. | |
| 6,705,840 | B1 | | 3/2004 | Hauser et al. | |
| 6,971,233 | B1 | | 12/2005 | Holder | |
| 7,107,892 | B2 | | 9/2006 | Dong | |
| 7,137,250 | B1 | | 11/2006 | McCoy et al. | |
| 7,278,263 | B1 | * | 10/2007 | Bennett et al. | 60/488 |
| 7,296,594 | B1 | * | 11/2007 | Phanco | 137/599.18 |
| 2005/0220637 | A1 | | 10/2005 | Kopel et al. | |

FOREIGN PATENT DOCUMENTS

| | | |
|---|---|---|
| DE | 19860466 | 6/2000 |
| JP | 2000120575 | 4/2000 |
| JP | 2002242824 | 8/2002 |
| JP | 2002310055 | 10/2002 |

* cited by examiner

*Primary Examiner* — Peter J Bertheaud
*Assistant Examiner* — Dnyanesh Kasture
(74) *Attorney, Agent, or Firm* — Renner, Otto, Boisselle & Sklar, LLP

(57) ABSTRACT

A pump having an endplate with an orifice provided between the system ports and the charge pump pressure cavity. Fluid flows through the orifice so as to soften a transition of the vehicle from a stationary position to a forward or reverse motion when a swash plate of the pump is angled slightly relative to a neutral or zero position.

17 Claims, 5 Drawing Sheets

HYDRAULIC PUMP END COVER

CROSS REFERENCE TO RELATED APPLICATIONS

The present application claims the benefit of the filing date of U.S. Provisional Patent Application Ser. No. 60/921,566, filed Apr. 3, 2007, the disclosure of which is incorporated herein by reference.

FIELD OF THE INVENTION

The present invention relates generally to axial piston pumps, and more particularly to an end cover for an axial piston pump having an orifice between the system ports and the charge pump pressure cavity.

BACKGROUND

Axial piston pumps include an enclosure having an end cover and a housing portion that connects to the end cover. The end cover seals an internal sump of the pump and includes porting for the pump and includes a charge pump running surface. The porting commonly includes (i) an inlet port for providing a fluid inlet to the charge pump; (ii) internal porting from the charge pump to the enclosed axial piston pump; (iii) system ports (commonly referred to as A and B ports) for connection to a hydraulic motor; (iv) valving ports for receiving valves (such as check valve, pressure relief valve, or a combination valve) for preventing pressure spikes and for charging the hydrostatic circuit; (v) optionally a bypass valve port is provided for receiving a bypass valve that may be opened for enabling free flow between the system ports by bypassing the axial piston pump; (vi) optionally a case drain for connection to the internal sump of the hydraulic pump may be formed in the end cover. An end cover having such porting is shown and described in U.S. Pat. No. 6,332,393, hereby incorporated by reference.

The valving for the hydraulic pump may include an orifice. The orifice commonly is located in the valve seat of the check, pressure relief, or combination valve or in the end of the bypass valve. U.S. Pat. No. 6,332,393 at FIG. 15 discloses the orifice in the bypass valve.

Fluid flows through the orifice so as to soften a transition of the vehicle from a stationary position to a forward or reverse motion. When a swash plate of the pump is angled slightly relative to a neutral or zero position, flow generated by the pump passes through the orifice from a high pressure port to a lower pressure cavity (such as the low pressure port). As a result, a vehicle operated by pumps with such orifices is not set into motion as a result of the slight angle of the swash plate.

Problems with the orifices in the valves include the fact that the valves may be accidentally replaced by valves without orifices and that the special orifice valves are expensive.

SUMMARY

At least one embodiment of the invention provides a hydraulic apparatus comprising: a housing body, an end cover attachable to the housing, the end cover comprising: an end cover body comprising a first system port and a second system port; a charge pump pressure cavity formed in the end cover body between the first system port and the second system port; and a passageway formed through a portion of the housing body connecting at least one of the first and second system ports to the charge pump pressure cavity, the passageway including an orifice.

At least one embodiment of the invention provides an end cover for a hydraulic apparatus, the end cover comprising: an end cover body comprising a first system port and a second system port; a first valve port and a second valve port formed coaxially in the end cover body and perpendicular to the system ports; a passageway formed through a portion of the end cover body through a wall of each of the first and second system ports, fluidly connecting the first and second system ports, the passageway including at least one orifice.

At least one embodiment of the invention provides a method for producing an end cover for a hydraulic pump, comprising the steps of: forming a first system port, a second system port, and a charge pump pressure cavity in a first side of an end cover; forming a first valve cavity on a second side of the end cover; forming a second valve cavity on a third side of the end cover; forming a first passageway fluidly connecting the first system port to the charge pump pressure cavity, the first passageway including a first orifice; forming a second passageway fluidly connecting the second system port to the charge pump pressure cavity, the second passageway including a second orifice.

BRIEF DESCRIPTION OF THE DRAWINGS

Embodiments of this invention will now be described in further detail with reference to the accompanying drawing, in which.

DETAILED DESCRIPTION OF THE DRAWINGS

Figure 1:
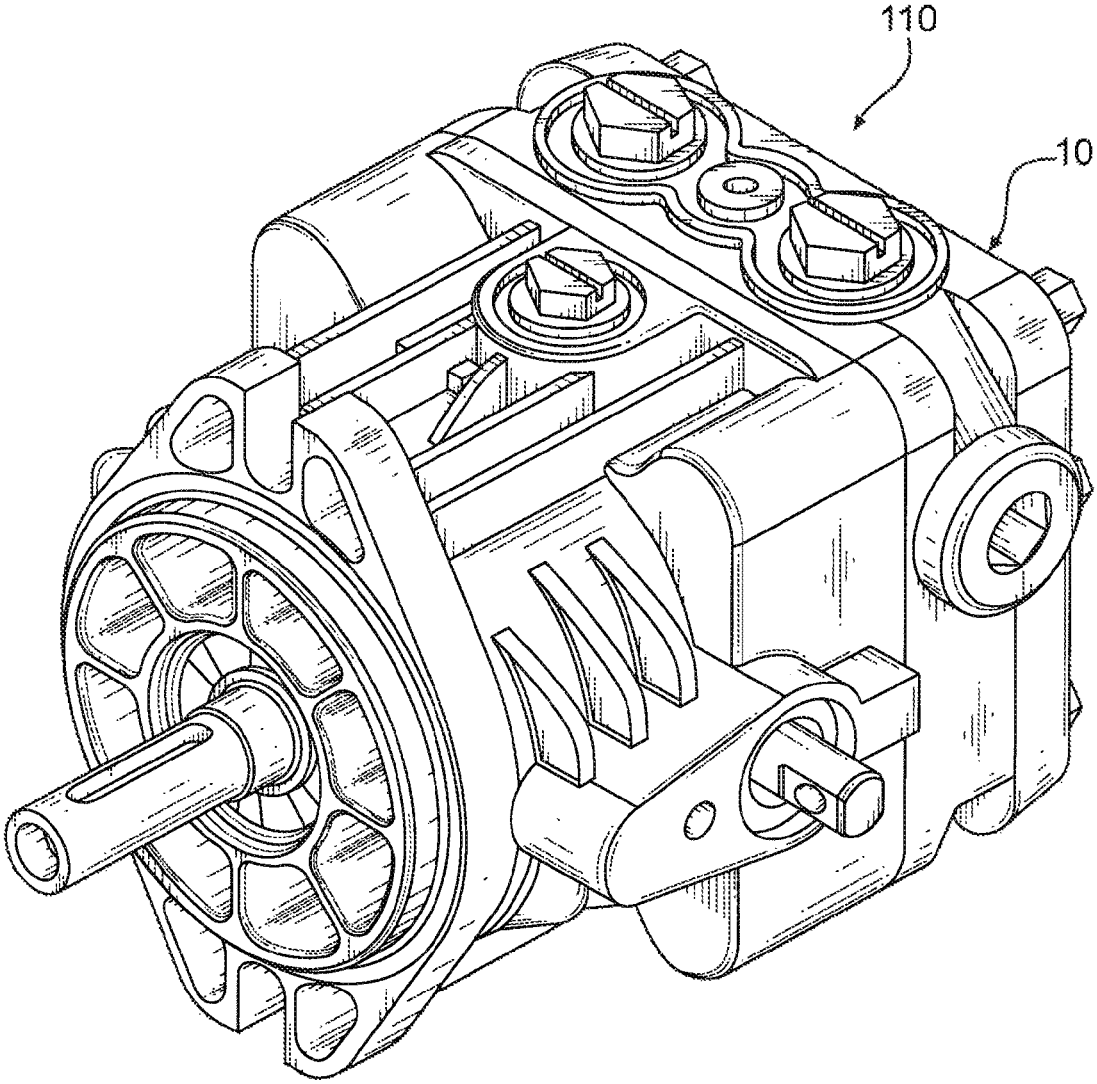
FIG. 1 is a perspective view an embodiment of a hydraulic pump assembly in accordance with an embodiment of the present invention shown including an end cover.
Figure 2:
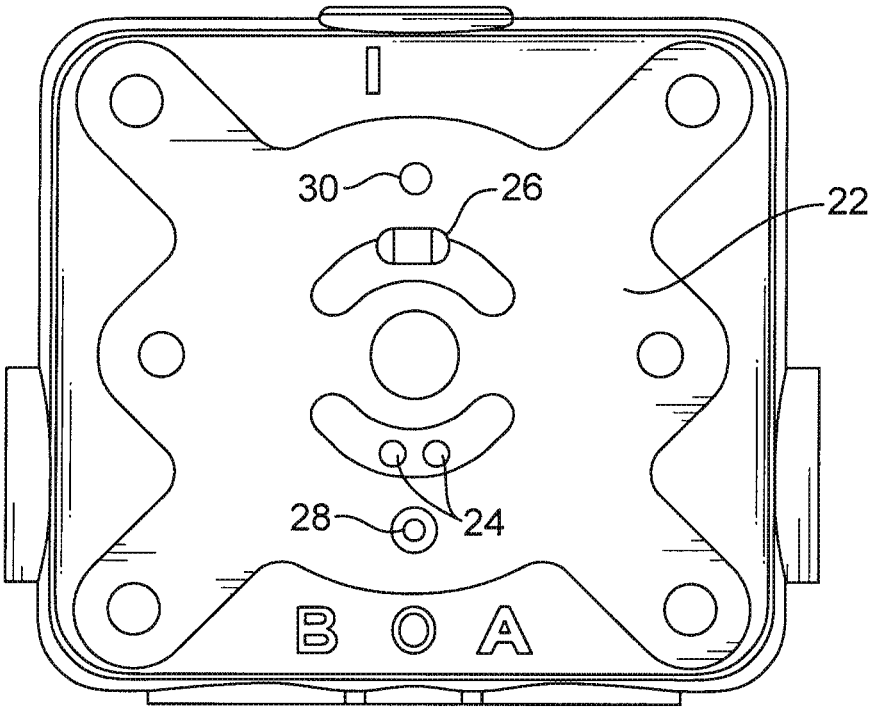
FIG. 2 is plan view of a first side of the end cover shown in FIG. 1.
Figure 3:
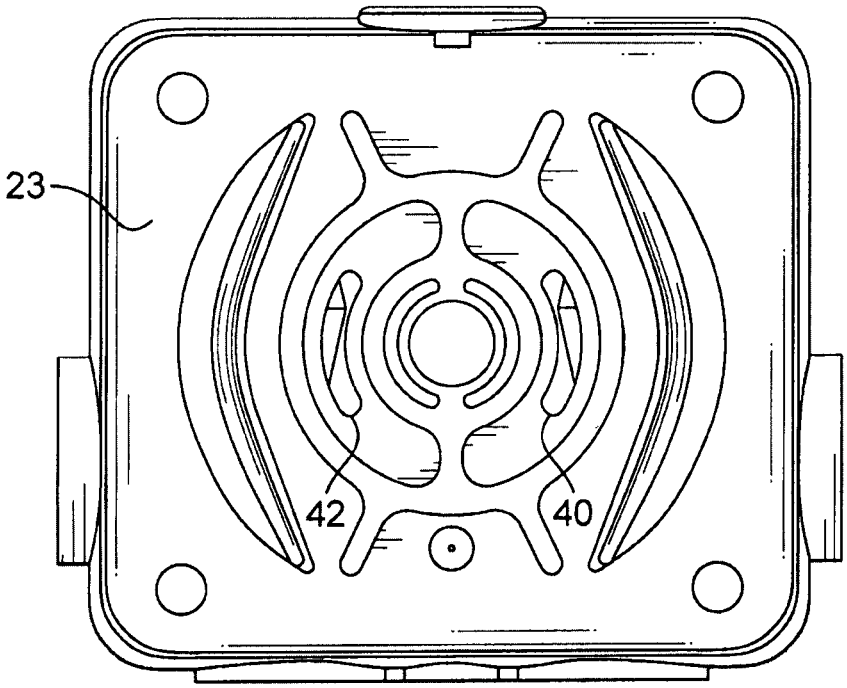
FIG. 3 is plan view of a second side of the end cover shown in FIG. 1.
Figure 4:
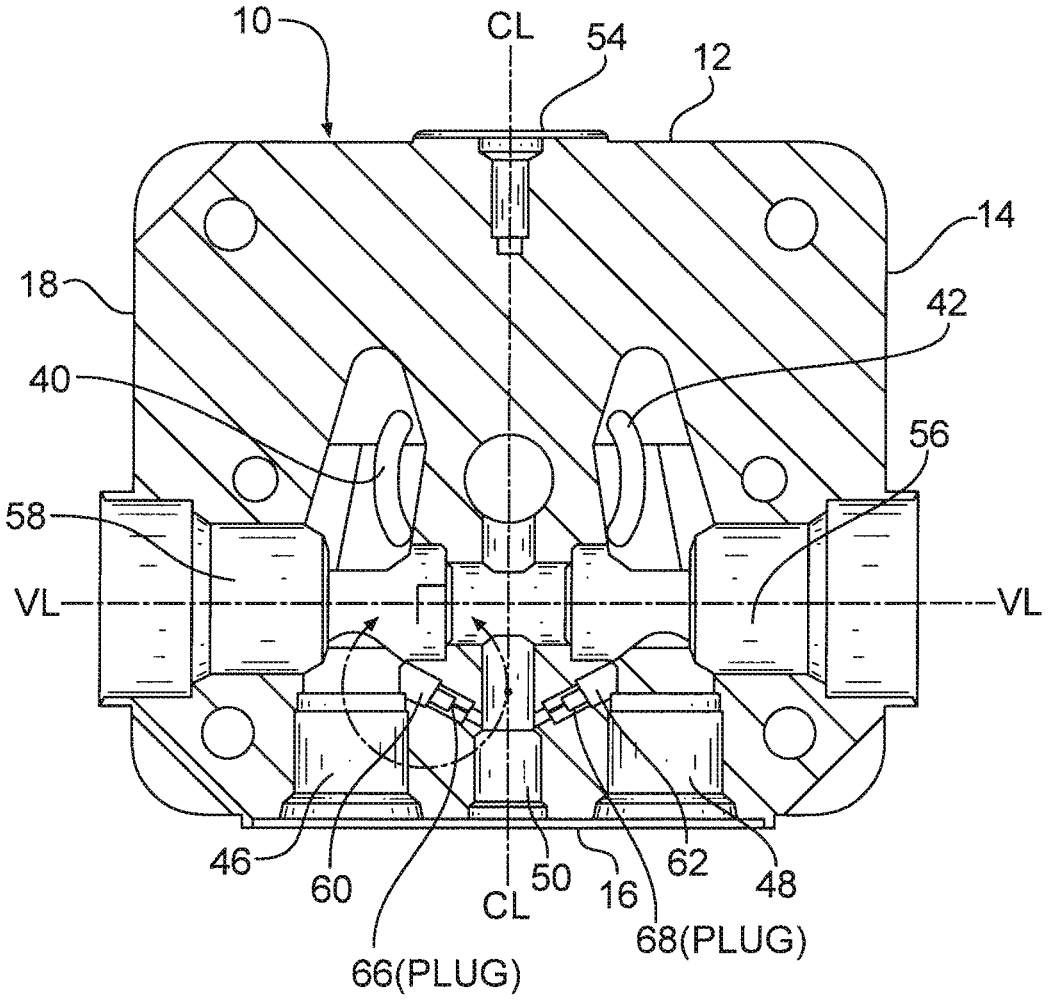
FIG. 4 is a cross-sectional view of the end cover taken through a plane parallel to the surfaces of the first and second sides of the end cover at a equal distance from the first and second sides.

FIG. 1 illustrates a hydraulic pump, such as an axial piston pump 110, having an end cover 10, in accordance with an embodiment of the present invention. The end cover 10, as shown in FIGS. 2-4 has a generally rectangular cross-sectional shape defined by four outer surfaces, 12, 14, 16, and 18 (identified in FIG. 4). The end cover also has a first side surface 22, and a second side surface 23, shown in FIGS. 2 and 3, respectively. FIG. 4 is a cross-section taken between the first and second side surfaces.

Referring now to FIG. 2, the first side surface 22 includes the running surface for the charge pump, a port 24 connecting to a charge pump outlet, a port 26 connecting to the charge pump inlet port, a charge pump relief port 28, and a recirculation port 30. The second side surface 23, shown in FIG. 3, includes two kidney shaped ports 40 and 42 for the axial piston pump. Port 40 connects to a first system port (shown at 46 in FIG. 4) of the end cover 10 and, port 42 connects to a second system port (shown at 48 in FIG. 4) of the end cover 10.

As shown in FIG. 4, the first and second system ports 46 and 48 extend into the end cover 10 from outer surface 16. The system ports 46 and 48 are connected to a hydraulic motor by fluid conduits for providing fluid to and receiving fluid from the hydraulic motor. Depending upon a desired rotation of the hydraulic motor, fluid may flow out of either system port 46 or 48 and return via the other system port 48 or 46.

Outer surface 16 of the end cover 10 also includes an opening for a construction port. The construction port extends into the end cap 10 to provide a charge pump pressure cavity 50 for connecting the charge pump to the system ports 46 and 48.

Outer surface 12 of the end cover 10 is located opposite of the outer surface 16. An opening to an inlet port 54 is located on outer surface 12. The inlet port 54 connects the charge pump to a system reservoir (not shown) associated with the hydraulic circuit.

Outer surface 14 is located perpendicular to outer surfaces 12 and 16 and includes an opening for a cavity 56 to receive a valve. The opening 56 may or may not include an external boss, but is shown in that manner for illustrative purposes. The cavity 56 extends from the opening on outer surface 14 to a centerline CL of the end cover 10. Outer surface 18 is located opposite outer surface 14 and perpendicular to outer surfaces 12 and 16. Outer surface 18 includes an opening for a cavity 58 to receive a valve. The opening 56 may or may not include an external boss, but is shown in that manner for illustrative purposes. The cavity 58 extends from the opening on outer surface 18 to a centerline CL of the end cover 10 and is axially aligned with and connects to cavity 56 at the centerline CL.

As shown in FIG. 4, each of the system ports 46 and 48 intersect a respective cavity 56 and 58. The charge pump pressure cavity 50 is located between the system ports 46 and 48 and intersects the valve cavities 56 and 58 along the centerline CL. Although not shown, valves housed in cavities 56 and 58 generally prevent the flow of fluid directly between the system ports 46 and 48, as well as between system ports 46 and 48 and the charge pressure cavity 50 (unless the valve is actuated). As discussed with respect to the prior art, if the swashplate of the pump is slightly off its neutral position, the pump will cause the vehicle to move as the hydraulic fluid flows through the pump. In the present invention, the above condition is remedied by allowing a small flow of fluid to pass directly from at least one of the system ports to the charge pressure cavity or from one system port to the other system port.

The end cover 10 includes at least one orifice passage 60 or 62 extending between a system port 46 or 48 and the charge pump pressure cavity 50. FIG. 4 illustrates two orifice passages 60 and 62. The first orifice passage 60 extends between system port 46 and the charge pump pressure cavity 50 and, the second orifice passage 62 extends between system port 48 and the charge pump pressure cavity 50. The orifice passages 60 and 62 illustrated in FIG. 4 are oriented oblique (non perpendicular nor axial with) relative to both the centerline CL and a valve cavity centerline VL. As shown, the openings of the orifice passages 60 and 62 at the intersection with the charge pump pressure cavity 50 are located closer to outer surface 16 than the openings of the orifice passage in the respective system ports 46 and 48. The orifice passages 60 and 62 illustrated in FIG. 4 are drilled into the end cover 10 by inserting a drill through the opening of the respective valve cavity 56 and 58 and drilling at an angle toward the charge pump pressure cavity 50. In one embodiment, after drilling the orifice passages 60 and 62, the orifice passages 60 and 62 are tapped to create threads on the surfaces defining the orifice passages. Alternatively, the orifice passages 60 and 62 may be cast into the end cover.

In one embodiment of the invention, the end cover 10 also includes at least one orifice plug configured capable of receiving an associated orifice passage. FIG. 4 illustrates a first orifice plug 66 in orifice passage 60 and a second orifice plug in orifice passage 62. Alternatively, if two orifice passages are formed in the end cap, such as orifice passages 60 and 62 of FIG. 4, one of the orifice passages may be plugged with a plug not having an orifice, if so desired. If it is desired to have an orifice connecting both system ports 46 and 48 with the charge pump pressure cavity 50, then two orifice plugs, such as 66 and 68 of FIG. 4 may be used.

Figure 5:
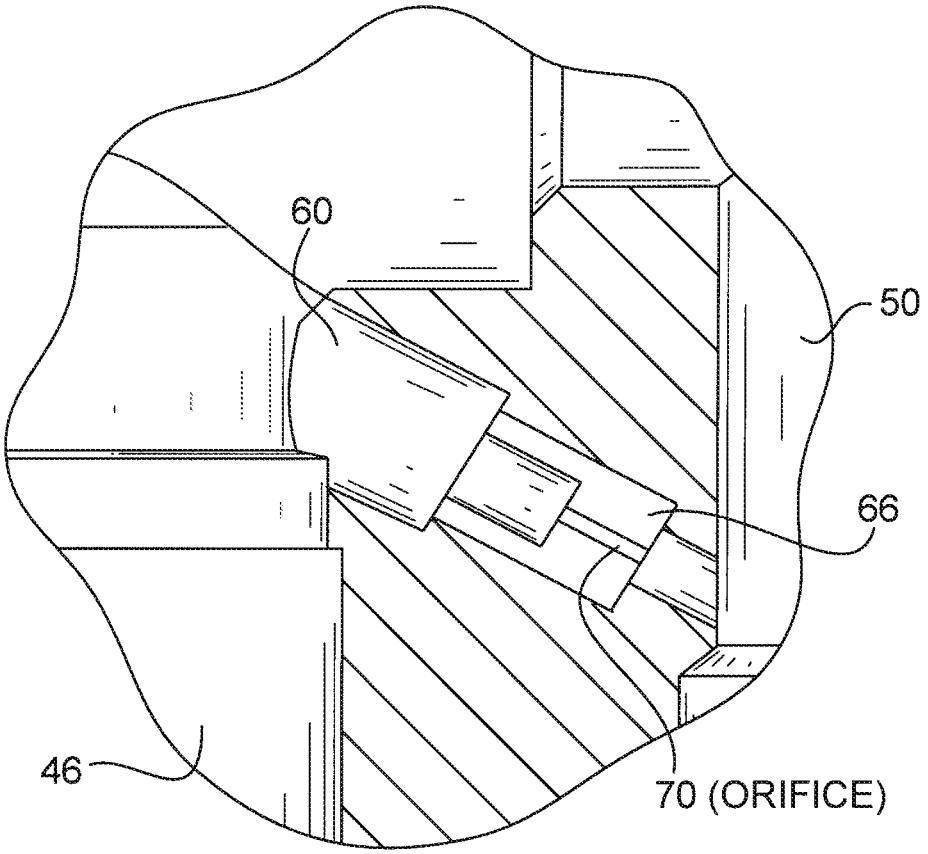
FIG. 5 is a detail sectional view of an orifice as shown in FIG. 4.

FIG. 5 is an enlarged view of orifice passage 60 and illustrates orifice plug 66 within the orifice passage. Orifice plug 66 includes a threaded outer surface for enabling the orifice plug to be threadedly received in the orifice passage 60. An orifice 70 extends through the orifice plug 66 to enable fluid flow through the orifice plug between the system port 46 and the charge pump pressure cavity 50. In one embodiment, the orifice plug 66 is a setscrew type plug formed from metal. Other forms of the orifice plug 66 are also contemplated by this invention. For example, the orifice plug 66 may be formed from plastic or may be metal injection molded. Also, expansion type orifice plugs may be used or orifice plugs may be press fit into the associated orifice passage.

The orifice 70 may be of various diameters so as to enable various amounts of flow through between the system port and the charge pump pressure cavity. Also, the present design enables replacement of an orifice plug with either an orifice plug having a different orifice size or no orifice.

Although the principles, embodiments and operation of the present invention have been described in detail herein, this is not to be construed as being limited to the particular illustrative forms disclosed. They will thus become apparent to those skilled in the art that various modifications of the embodiments herein can be made without departing from the spirit or scope of the invention. Accordingly, the scope and content of the present invention are to be defined only by the terms of the appended claims.

What is claimed is:

1. A hydraulic apparatus comprising:

a housing body, and an end cover attachable to the housing, the end cover comprising:

an end cover body comprising a first system port and a second system port;

a charge pump pressure cavity formed in the end cover body between the first system port and the second system port;

a first valve port and a second valve port formed coaxially in the end cover body and having a common first central axis, the common central axis being perpendicular to central axes of the system ports, the valve ports connecting the system ports to the charge pump pressure cavity; and a passageway, separate and distinct from the valve ports, formed through a portion of the end cover body connecting at least one of the first and second system ports to the charge pump pressure cavity, the passageway including an orifice that has a second central axis in a hydraulic flow direction through the orifice, wherein the second central axis intersects the first central axis.

2. The hydraulic apparatus of claim 1, the end cover further comprising a second passageway, separate and distinct from the valve ports, formed through a second portion of the end cover body connecting the other of the least one of the first and second system ports to the charge pump pressure cavity, the second passageway including a second orifice.

3. The hydraulic apparatus of claim 2, wherein the passageways are formed oblique to the system ports.

4. The hydraulic apparatus of claim 2, wherein the passageways are formed oblique to the common first central axis of the valve ports.

5. The hydraulic apparatus according to claim 2, wherein a plug is fully contained in each of the passageway and the second passageway, and wherein the orifice and second orifice are formed in the respective plug and extend through the respective plug.

6. The hydraulic apparatus of claim 2, wherein the second orifice has a third central axis in a hydraulic flow direction through the orifice, and wherein the third central axis intersects the first central axis.

7. The hydraulic apparatus of claim 1, wherein a plug is positioned in the passageway, the orifice being formed in the plug and also extending through the plug.

8. The hydraulic apparatus of claim 7, wherein the plug is fully contained in the passageway.

9. The hydraulic apparatus of claim 8, wherein the plug has a threaded outer surface for threadably engaging threads in the passageway.

10. An end cover for a hydraulic apparatus, the end cover comprising:

an end cover body comprising a first system port and a second system port;

a first valve port and a second valve port formed coaxially in the end cover body and perpendicular to central axes of the system ports;

a passageway formed through a portion of the end cover body through a wall of each of the first and second system ports, the passageway being separate and distinct from the first and second valve ports, the passageway fluidly connecting the first and second system ports, the passageway including at least one orifice having a first central axis in a hydraulic flow direction through the at least one orifice, wherein the first and second valve ports have a common second central axis, and wherein the first central axis intersects the second central axis.

11. The end cover of claim 10, wherein at least a portion of the passageway is formed oblique to the system ports.

12. The end cover of claim 10, the end pump body further comprising a charge pump pressure cavity formed in the end cover body between the first system port and the second system port.

13. The end cover of claim 12, wherein the charge pump pressure cavity intersects at least a portion of the passageway.

14. The end cover of claim 13, wherein a plug is positioned in the passageway, the orifice being formed in the plug and also extending through the plug.

15. The end cover of claim 10, wherein a plug is positioned in the passageway, the orifice being formed in the plug and also extending through the plug.

16. A method of making an end cover, the end cover including an end cover body comprising a first system port and a second system port, a charge pump pressure cavity formed in the end cover body between the first system port and the second system port, a first valve port and a second valve port formed coaxially in the end cover body and having a common first central axis, the common central axis being perpendicular to central axes of the system ports, the valve ports connecting the system ports to the charge pump pressure cavity, and a passageway separate and distinct from the valve ports and formed through a portion of the end cover body connecting at least one of the first and second system ports to the charge pump pressure cavity, the passageway including an orifice that has a second central axis hi a hydraulic flow direction through the orifice, wherein the second central axis intersects the first central axis, the method including:

inserting a drill bit through an opening of one of the first or second valve ports to one of the first and second system ports; and drilling at an angle through the first or second system port into the charge pump pressure cavity to form the passageway between one of the system ports and the charge pump pressure cavity.

17. The method according to claim 16, further including inserting a plug in a straight line into the passageway through the first or second valve port, wherein the plug is fully contained in the passageway after insertion.

* * * * *